US008950485B2

(12) United States Patent
Wilkins et al.

(10) Patent No.: US 8,950,485 B2
(45) Date of Patent: Feb. 10, 2015

(54) DRILLING/FRAC ADAPTER AND METHOD OF USE

(75) Inventors: Danny R. Wilkins, Tyler, TX (US); Thomas H. Holtkamp, Dickinson, TX (US); Jerry D. Smith, Spring, TX (US)

(73) Assignee: GE Oil & Gas Pressure Control LP, Houston, TX (US)

( * ) Notice: Subject to any disclaimer, the term of this patent is extended or adjusted under 35 U.S.C. 154(b) by 547 days.

(21) Appl. No.: 13/341,703

(22) Filed: Dec. 30, 2011

(65) Prior Publication Data

US 2013/0014947 A1 Jan. 17, 2013

Related U.S. Application Data

(60) Provisional application No. 61/508,418, filed on Jul. 15, 2011.

(51) Int. Cl.

| | |
|---|---|
| ***E21B 43/16*** | (2006.01) |
| ***E21B 34/02*** | (2006.01) |
| ***E21B 33/02*** | (2006.01) |
| ***E21B 43/26*** | (2006.01) |
| ***E21B 33/068*** | (2006.01) |

(52) U.S. Cl.

CPC ..... *E21B 43/26* (2013.01); *E21B 33/068* (2013.01)

USPC ..... 166/281; 166/308.1; 166/380; 166/382; 175/57

(58) Field of Classification Search

CPC ..... E21B 43/16; E21B 43/26; E21B 33/03; E21B 33/04; E21B 33/05; E21B 33/068; E21B 34/02; E21B 34/045

USPC ..... 166/305.1, 308.1, 308.2, 308.3, 308.4, 166/308.5, 308.6, 380, 382, 177.4, 177.5; 175/57, 61, 62

See application file for complete search history.

(56) References Cited

U.S. PATENT DOCUMENTS

| | | | | |
|---|---|---|---|---|
| 5,540,282 | A | 7/1996 | Dallas | |
| 6,179,053 | B1 | 1/2001 | Dallas | |
| 6,289,993 | B1 | 9/2001 | Dallas | |
| 6,364,024 | B1 | 4/2002 | Dallas | |
| 6,470,965 | B1 | 10/2002 | Winzer | |
| 6,516,861 | B2 | 2/2003 | Allen | |
| 6,666,266 | B2 | 12/2003 | Starr et al. | |
| 6,817,423 | B2 | 11/2004 | Dallas | |
| 7,055,632 | B2 | 6/2006 | Dallas | |
| 7,066,269 | B2 | 6/2006 | Dallas et al. | |
| 7,069,987 | B2 * | 7/2006 | Kwasniewski et al. | 166/85.3 |
| 7,308,934 | B2 | 12/2007 | Swagerty et al. | |
| 7,614,448 | B2 | 11/2009 | Swagerty et al. | |

(Continued)

*Primary Examiner* — Blake Michener

*Assistant Examiner* — David Carroll

(74) *Attorney, Agent, or Firm* — Bracewell & Giuliani LLP

(57) ABSTRACT

A method of drilling and fracturing a well includes installing a drilling/frac adapter on a lower wellhead housing. The drilling/frac adapter has a higher internal pressure rating than the lower wellhead housing. The operator drills through the drilling/frac adapter to a desired depth, then runs and cements a casing string in the well. A lower packoff is installed in an annulus between the casing hanger and the lower wellhead housing and an upper packoff is set in an annulus between the drilling/frac adapter and the casing hanger. Frac fluid is pumped through the frac tree into the casing string at a higher pressure than the pressure rating of the lower housing but less than the pressure rating of the drilling/frac adapter. Then, the upper packoff and the drilling/frac adapter are removed from the lower housing and installing an upper wellhead housing on the lower wellhead housing.

17 Claims, 8 Drawing Sheets

(56) References Cited

U.S. PATENT DOCUMENTS

2003/0205385 A1* 11/2003 Duhn et al. ..... 166/380
2009/0090515 A1* 4/2009 Chan et al. ..... 166/382
2009/0211749 A1* 8/2009 Nguyen et al. ..... 166/75.11

* cited by examiner

DRILLING/FRAC ADAPTER AND METHOD OF USE

CROSS-REFERENCE TO RELATED APPLICATION

This application claims priority to provisional application Ser. No. 61/508,418, filed Jul. 15, 2011.

FIELD OF THE DISCLOSURE

This invention relates in general to oil and gas wellheads and in particular to a drilling and frac adapter utilized during the drilling and fracturing of the well.

BACKGROUND

Many hydrocarbon producing wells are now hydraulically fractured or fracked shortly after drilling. In one technique, after the production casing string is run and cemented, the operator will perforate the casing string and perform the fracturing operation. A frac adapter will mount on the upper end of the wellhead housing. The operator pumps high pressure frac fluid down the casing string, which flows out the perforations to form cracks or fissures in the earth formation. Afterward, the frac tree is removed and the wellhead configured for production.

The production fluid, often a mixture of gas, oil and water, will normally not have a very high pressure at the wellhead. During the fracturing process, the pressure in the wellhead will be high, often more than 5000 psi and in some cases more than 10,000 psi. To reduce the cost of the wellhead, the operator will typically install a wellhead assembly that has a pressure rating much lower than the expected fracturing pressure. For example, a production wellhead housing along with associated valves may have only a 5000 pressure rating.

A variety of devices are employable to avoid damage to the production wellhead equipment if the frac pressure exceeds the pressure rating. Generally, these devices insert into the bore of the production wellhead housing to protect the valves and production wellhead housing.

SUMMARY

This method includes installing a drilling/frac adapter on a lower wellhead housing, the drilling/frac adapter having a higher internal pressure rating than the lower wellhead housing. The operation drills through the drilling/frac adapter to a desired depth, then runs and cements a casing string in the well. The casing string has a casing hanger located partly in the lower wellhead housing and partly in the drilling/frac adapter. Then, the method includes installing a lower packoff in an annulus between the casing hanger and the lower wellhead housing and an upper packoff in an annulus between the drilling/frac adapter and the casing hanger. The operator installs a frac tree on the drilling/frac adapter and pumps frac fluid through the frac tree into the casing string at a higher pressure than the pressure rating of the lower housing but less than the pressure rating of the drilling/frac adapter. The upper packoff isolates the lower wellhead housing from the pressure of the frac fluid. After fracturing the well formation, the operator removes the upper packoff and the drilling/frac adapter from the lower housing and installs an upper wellhead housing on the lower wellhead housing.

Preferably, the drilling/frac adapter has a valve port extending through a side wall to a valve that has a pressure rating greater than the lower wellhead housing. The upper packoff seals to the drilling/frac adapter below the valve port in the preferred embodiment. The frac fluid being pumped into the frac tree is in fluid communication with the valve port and the valve.

After installing the upper and lower packoffs, the operator may installs a frac bushing on the upper packoff within the drilling frac/adapter. The upper and lower packoffs may be run simultaneously.

In an alternate method, prior to pumping frac fluid, the operator may install a protective sleeve within the upper packoff and casing hanger. Preferably, the protective sleeve admits frac fluid being pumped to an annular clearance between the protective sleeve and the casing hanger.

The operator may install a blowout preventer stack on the drilling/frac adapter before drilling through the drilling/frac adapter. Before removing the blowout preventer to install the frac tree, the operator preferably installs a retrievable plug in the casing hanger. The plug is retrieved through the frac tree before pumping frac fluid through the frac tree. Furthermore, after pumping frac fluid through the frac tree, the operator preferably installs a retrievable plug in the casing hanger before removing the frac tree and replacing the drilling/frac adapter with an upper wellhead housing.

To protect the bore of the drilling/frac adapter during drilling, the operator may insert a wear bushing into the drilling/frac adapter. The wear bushing is retrieved before running the casing string.

This disclosure also includes a wellhead apparatus for use during drilling and fracturing. The apparatus includes a lower wellhead housing adapted to be located at an upper end of a well. A drilling/frac adapter mounts on the lower wellhead housing. The drilling/frac adapter has a bore with an axis, a valve port extending laterally from the bore, and a valve mounted to the valve port. The drilling/frac adapter and the valve have a greater internal pressure rating than the lower wellhead housing. A wear bushing is positioned in the bore of the drilling/frac adapter during drilling to protect against damage to the bore from a drill string. A casing hanger adapted to be mounted to an upper end of a string of casing is landed in the lower wellhead housing after removal of the wear bushing. The casing hanger has an upper end within the bore of the drilling/frac adapter. A lower packoff is located in an annulus between the casing hanger and the lower wellhead housing. An upper packoff in is located in an annulus between the drilling/frac adapter and the casing hanger below the valve port. The casing hanger, the upper packoff, the drilling/frac adapter and the valve are adapted to be exposed to frac fluid pumped into the bore of the drilling/frac adapter. The upper packoff, the casing hanger and the drilling/frac adapter provide isolation of the lower wellhead housing from exposure to the frac fluid being pumped into the bore of the drilling/frac adapter.

The adapter and the upper packoff are removable from the lower wellhead housing without removing the lower packoff. A frac tree bolts to an upper end of the drilling/frac adapter while the frac fluid is being pumped into the drilling/frac adapter.

DETAILED DESCRIPTION OF THE DISCLOSURE

Figure 1:
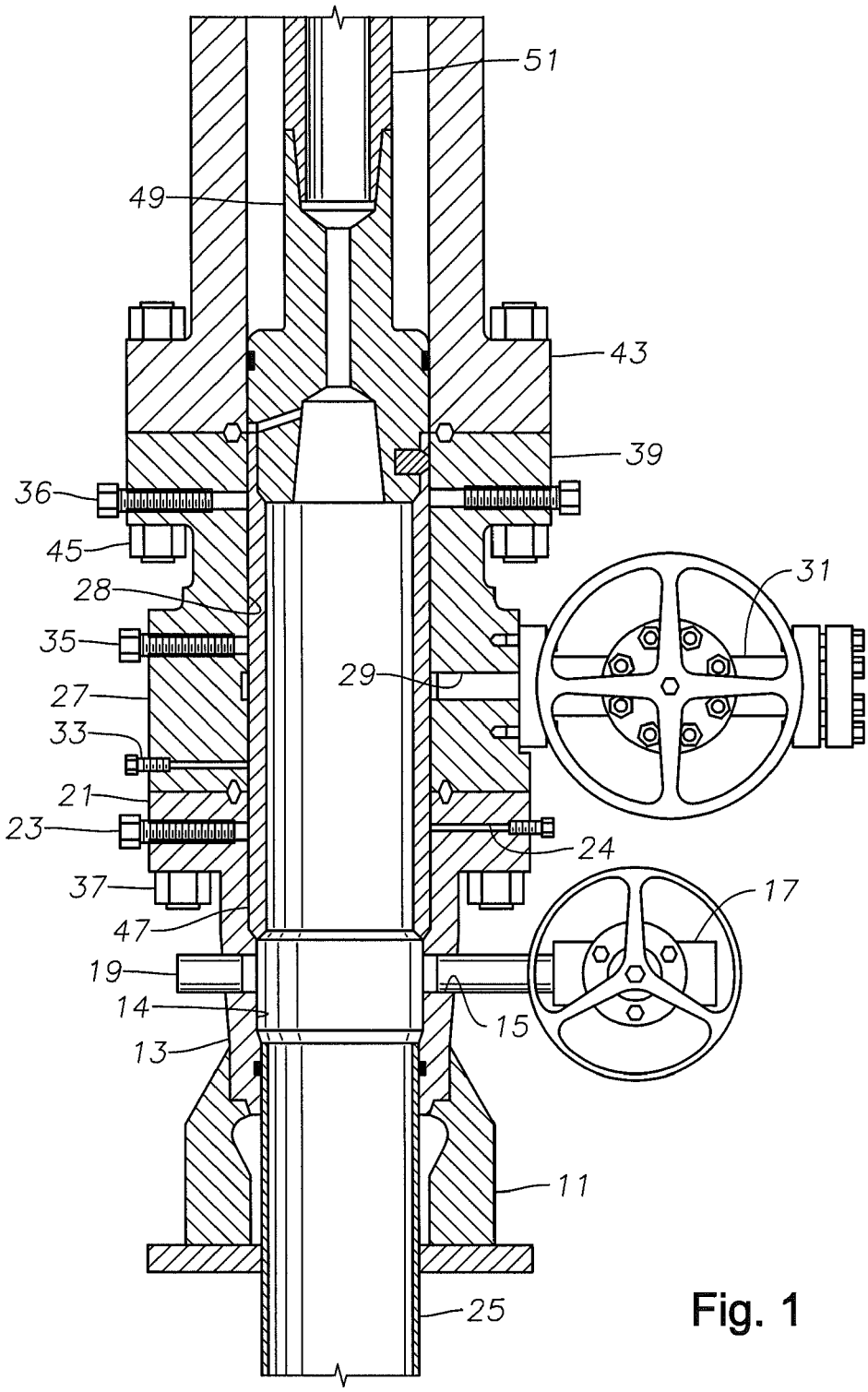
FIG. 1 is a sectional view illustrating a wellhead assembly having a drilling/frac adapter in accordance with this disclosure and shown in a drilling mode.

Referring to FIG. 1, the wellhead assembly includes a base plate 11 that supports a lower wellhead housing 13, which may also be called a casing head or spool. Lower wellhead housing 13 is a conventional tubular member having one or more valve ports 15 leading from its axially extending bore 14. One of the valve ports 15 illustrates a valve 17 connected to it. The other valve port contains a bull plug 19 as an example. Lower housing 13 has a flange 21 on its upper end. Lower housing 13 may also have a plurality of lock screws 23 (only one shown) spaced around its circumference. Lock screws 23 are conventional threaded pins that can be rotated to extend radially inward into bore 14 of lower wellhead housing 13 to secure hangers and the like landed in bore 14. In this embodiment, lower housing 13 also has a test port 24 that extends radially inward to bore 14 of lower housing 13.

In FIG. 1, the well has been drilled to the first depth and a string of surface casing 25 installed. Surface casing 25 is secured to the lower end of lower housing 13 and cemented within the well.

A drilling/frac adapter 27 is shown in FIG. 1 mounted on lower housing 13, either before or after surface casing 25 has been installed. Drilling/frac adapter 27 is a tubular member or spool, having an axial bore 28 with an upper portion having a diameter greater than the inner diameter of surface casing 25. The upper portion of bore 28 is preferably equal to or greater than the inner diameter of lower housing bore 14 at the largest diameter portion of bore 14. Normally at least one valve port 29 extends radially from bore 28 to the exterior. A valve 31 is secured to valve port 29 for controlling the flow of fluid into or out of valve port 29. Drilling/frac adapter 27 may also have one or more test ports 33 extending radially outward from bore 28 of drilling/frac adapter 27. In this example, drilling/frac adapter 27 has a lower set of lock screws 35 spaced circumferentially around its exterior. An upper set of lock screws 36 is also spaced circumferentially around drilling/frac adapter 27. Lock screws 35, 36 may be the same type as lock screws 23 and are spaced circumferentially around drilling/frac adapter for entry into bore 28 when rotated in one direction. The lower end of drilling/frac adapter 27 mounts and seals to the upper end of flange 21 of lower housing 13 and may be secured by bolts 37. Drilling/frac adapter 27 has a flange 39 at its upper end.

Drilling/frac adapter 27 is constructed with a higher internal pressure capability than lower housing 13. Also, valve 31 has a higher pressure capability than valve 17. For example, the rated capacity of lower housing 13 and valve 17 may be 5,000 psi. The rated capacity of drilling/frac adapter 27 and valve 31 is sufficient for the fracturing operations to be later performed on the well. For example, the pressure rating of drilling/frac adapter 27 and valve 31 would typically be at least 10,000 psi. Drilling/frac adapter 27 and its valve 31 are not intended to remain with the completed wellhead assembly, rather are utilized only during drilling and fracturing operations.

For drilling operations, a blowout preventer ("BOP") stack 43 mounts to the upper end of drilling/frac adapter 27. BOP stack 43 may comprise conventional pressure control equipment, such as pipe rams, shear rams and an annular blowout preventer that will close to prevent the flow of fluid from the wellbore in the event of a kick occurring while drilling. Bolts 45 secure the lower end of BOP stack 43 to upper flange 39.

To avoid damage to drilling/frac adapter bore 28 and lower housing bore 14 during drilling, a drilling wear bushing 47 is installed. Drilling wear bushing 47 is a conventional sleeve that fits closely within bore 28 of drilling/frac adapter 27. Preferably, the lower end of drilling wear bushing 47 extends into the upper portion of bore 14 of lower housing 13. In this example, drilling wear bushing 47 does not seal to either bore 28 or bore 14. The inner diameter of drilling wear bushing 2847 is preferably equal to or greater than the inner diameter of surface casing 25. A conventional running tool 49 is illustrated in FIG. 1 in the process of installing drilling wear bushing 47. In this example, running tool 49 is lowered on a section of drill pipe 51 through BOP stack 43. Once installed, running tool 49 is retracted, leaving drilling wear bushing 47 in place for drilling operations.

The operator will drill the well to a greater depth while the wellhead assembly is configured as shown in FIG. 1. The drilling is performed by securing a drill bit (not shown) to drill pipe 51 and lowering the bit to the bottom of the well. Normally the bit will be rotated, either by rotating drill pipe 51 or by rotating the drill bit relative to drill pipe 51, or both. Drilling fluid is pumped down drill pipe 51, with cuttings flowing back with the returning fluid in the annulus surrounding drill pipe 51.

Figure 2:
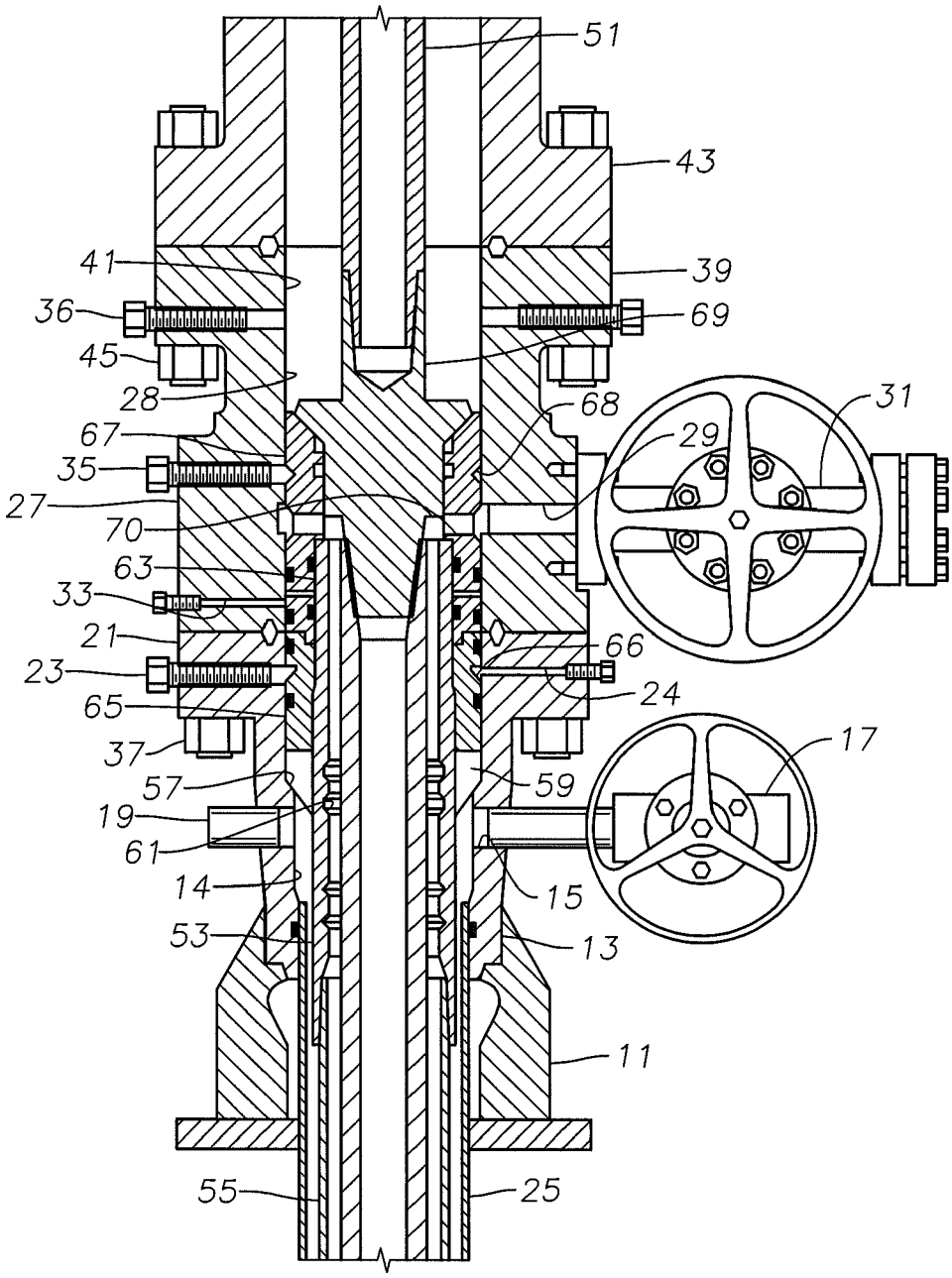
FIG. 2 is a sectional view of the wellhead assembly of FIG. 1, showing production casing installed and casing hanger packoffs being landed through the blowout preventer stack.

Referring to FIG. 2, after drilling the well to the deeper depth, the operator retrieves drilling wear bushing 47 and runs production casing 55. A casing hanger 53 is secured to the upper end of production casing 55. Preferably, casing hanger 53 and production casing 55 are lowered through BOP stack 43. Casing hanger 53 is a tubular member having a shoulder that lands on an annular load shoulder 57 in bore 14 of lower housing 13. Casing hanger 53 may have conventional flow-by passages 59 to allow a return of fluid in the annulus between casing hanger 53 and lower housing bore 14 while production casing 55 is being cemented in the well. Casing hanger 53 has an internal plug profile 61 in its bore that in this example has upper and lower sets of annular grooves. Casing hanger 53 also has a casing hanger neck 63 that extends upward past the upper end of lower housing 13 and into a lower portion of bore 28 of drilling/frac adapter 27.

After the production casing 55 has been cemented in place, the operator will install a lower packoff 65 and an upper packoff 67. Packoffs 65, 67 may be temporarily threaded together and run through BOP stack 43 as a unit by a running tool 69. Lower packoff 65 seals an annulus between the exterior of casing hanger 53 and a side wall of bore 14 in lower housing 13. Lower packoff 65 has an upper end that is flush or recessed below the upper end of lower housing 13. Lower packoff 65 may have an external circumferential groove 66 for engagement by rotating lock screws 23 in lower housing 13 radially inward. Lower packoff 65 may be tested conventionally by using test port 24.

Upper packoff 67, which is directly above lower packoff 65, locates in and seals the annular space between casing hanger neck 63 and bore 28 in drilling/frac adapter 27. Upper packoff 67 extends above casing hanger 53 and has ports 70 extending through it that register with valve port 29. Upper packoff 67 is utilized only during drilling and fracturing operations, and will not remain with the wellhead assembly after completion. Upper packoff 67 has an exterior circumferential groove that is engaged by rotating lock screws 35 of drilling/frac adapter 27 radially inward. Upper packoff 67 may be tested conventionally by employing test port 33. The test pressure applied to test port 33 may be higher than the pressure rating of lower housing 13, but lower housing 13 is isolated from the test pressure by the seals on upper packoff 67. Lower and upper packoffs 65, 67 may be a variety of types. In the embodiment shown, each is a metal ring with elastomeric seals on the inner and outer diameters. Both of the seals on upper packoff 67 are located below valve ports 70 in this example.

Figure 3:
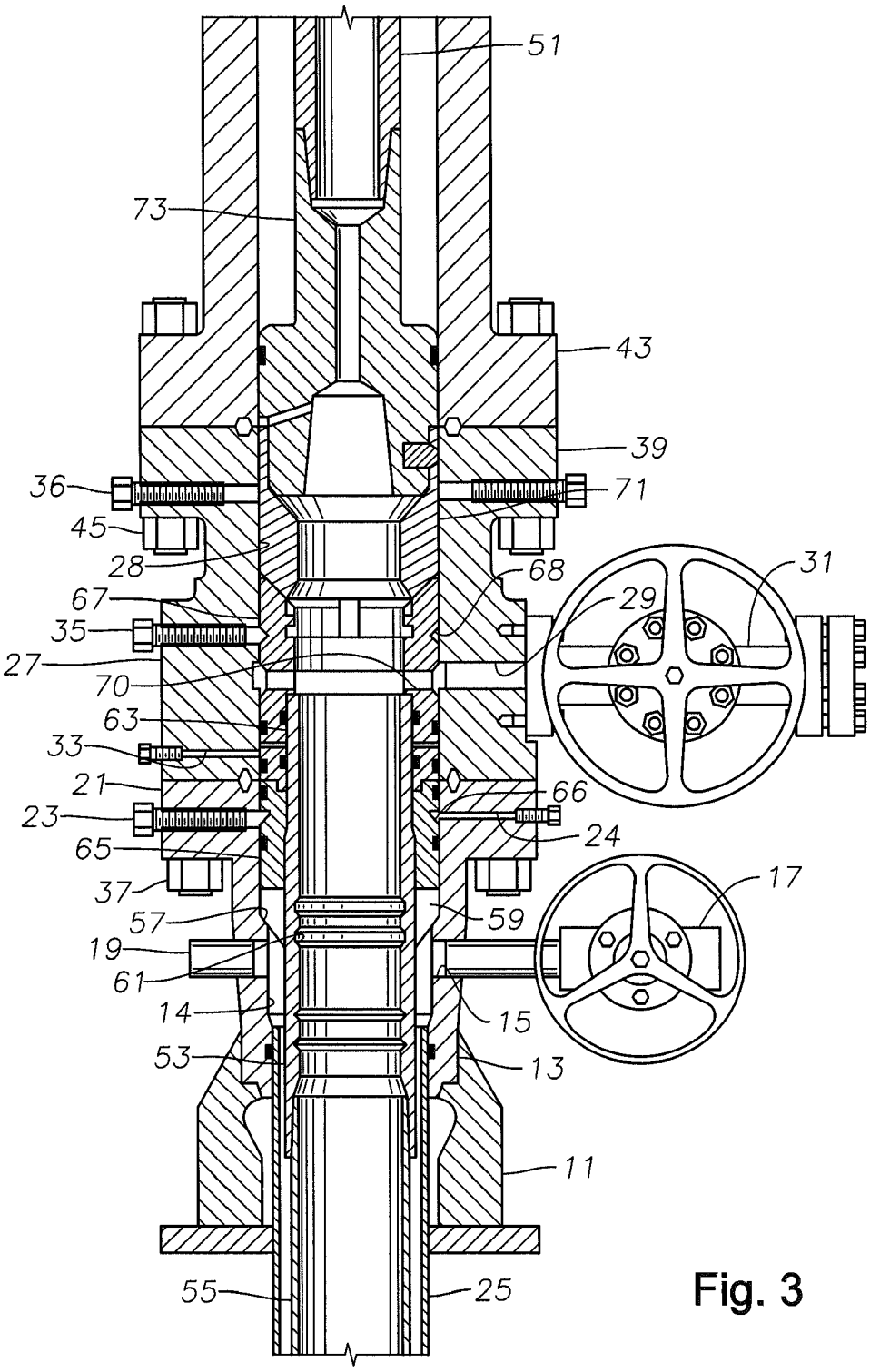
FIG. 3 is a sectional view of the wellhead assembly of FIG. 2, showing a frac wear bushing being installed.

Referring to FIG. 3, after installing packoffs 65, 67, the operator employs a running tool 73 to install a frac wear bushing 71 in bore 28 of drilling/frac adapter 27. Frac wear bushing 71 lands on the upper end of upper packoff 67 and extends to the upper end of bore 28. In this example, the upper end of upper packoff 67 is spaced some distance below upper lock screw set 36. Running tool 73 is illustrated as being lowered through BOP stack 43 and installing frac wear bushing 71. Frac wear bushing 71 is a tubular member that extends upward past upper lock screws 36. Upper lock screws 36 may be rotated radially inward to engage an annular groove and secure frac wear bushing 71 within bore 28 of drilling/frac adapter 27. Running tool 73 is a conventional running tool that engages a counter bore within the upper portion of bore 28 of frac wear bushing 71. Frac wear bushing 71 protects bore 28 from erosion due to frac fluid being pumped down drilling/frac adapter 27 and does not necessarily seal to bore 28.

Often an operator will move the drilling rig from the well before completing the well and perform the completion work with a workover rig. If so, referring to FIG. 4, after installing frac wear bushing 71, the operator installs a conventional casing plug 75 within casing hanger 53 as a safety precaution. Casing plug 75 may be of various types, and in this embodiment is illustrated as being run on a running rod 77 that is rotated in order to set casing plug 75. Casing plug 75 is lowered through BOP stack 43 while being installed. Casing plug 75 has seals that seal to the bore of casing hanger 53 above and below plug profile 61 and below valve ports 70. Casing plug 75 has dogs 79 that are moved radially outward by rotation of running rod 77 to engage profile 61 and secure casing plug 75 in place. It is unlikely that any well pressure will develop in production casing 55, but if so, casing plug 75 will hold the pressure. The operator at this point may disconnect BOP stack 43 and secure a temporary cap (not shown) to the upper end of drilling/frac adapter 27. The drilling rig may then be moved to another location.

Figure 4:
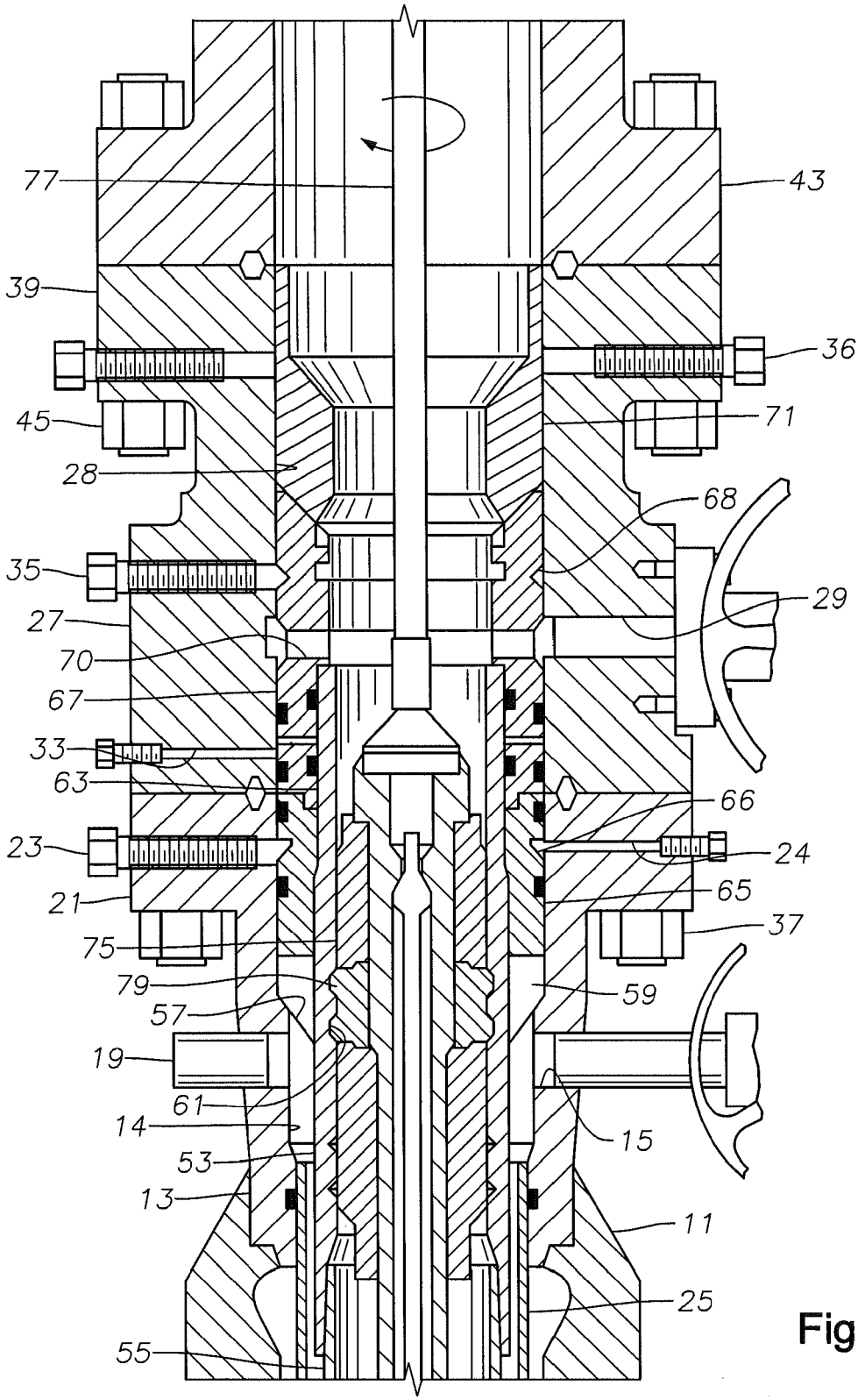
FIG. 4 is an enlarged sectional view of the wellhead assembly of FIG. 3, shown with a casing plug being installed prior to removing the blowout preventer.
Figure 5:
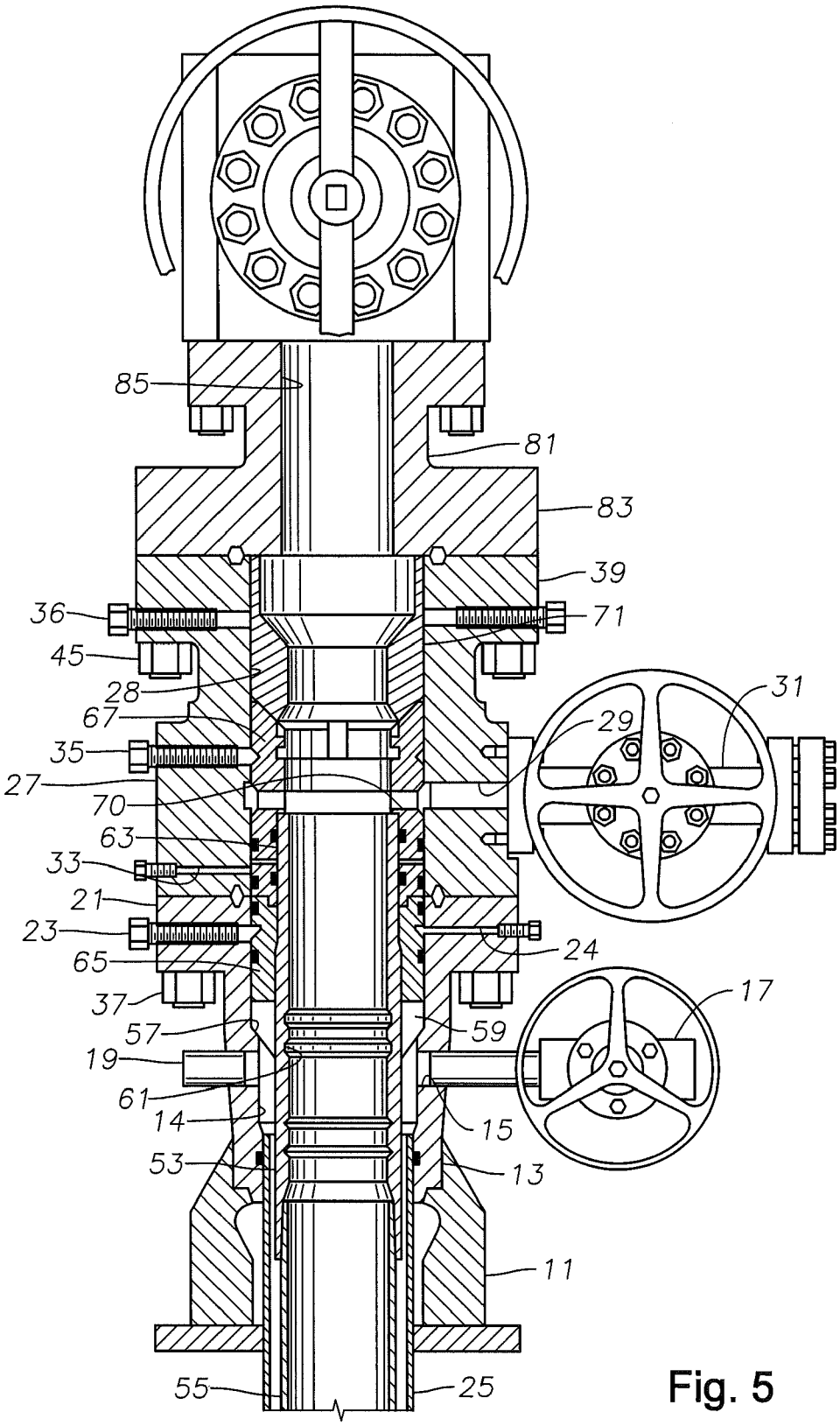
FIG. 5 is a sectional view of the wellhead assembly of FIG. 4, shown with the blowout preventer removed and a frac tree installed in place of the blowout preventer.

When the operator decides to complete the well, the operator will remove the protective cap and install a conventional frac tree or adapter 81 in place, as illustrated in FIG. 5. Frac tree 81 bolts to the upper end of drilling/frac adapter 27 in the same place previously occupied by BOP stack 43 (FIG. 4). Frac tree 81 has a lower flange 83 that secures to drilling/frac adapter 27 by bolts 45. Frac tree 81 has a bore 85 through which fracturing fluid will be pumped to fracture the well. Frac tree 81 is a conventional assembly having valves for coupling to lines leading to frac equipment trailers and trucks. The operator may remove casing plug 75 (FIG. 4) through bore 85 of frac tree 81. In this example, the inner diameter of bore 85 in frac tree 81 is the same or larger than the inner diameter of production casing 55 as well as the inner diameter of casing hanger 53. In this embodiment, bore 85 is smaller in diameter than frac wear bushing 71.

Different techniques may be employed to frac and complete the well. In some techniques, the operator will lower perforating equipment (not shown) through frac tree 81 to perforate production casing 55. Valve 31 may be employed along with a tubular string and frac tree 81 to circulate fluid into and out of the well before or after perforating. After perforating at least one zone, the operator may fracture the well by pumping high pressure fluid, often containing proppants, down bore 85 and into the earth formation through the perforations. The high pressure fluid will normally be at a higher pressure than the pressure ratings of lower housing 13 and valve 17. It will be at a lesser pressure than the pressure ratings of drilling/frac adapter 27 and valve 31. The pressure exerted by the high pressure fluid will be applied to the bore of upper packoff 67, which by sealing against the outer diameter of casing hanger neck 63, seals the high pressure from lower housing 13. The high pressure will not be exposed to bore 14 of lower housing 13 or to valve 17. The higher frac pressure is exerted against the inner diameter of casing hanger 53 and production casing 55. The higher frac pressure also communicates with valve 31 via ports 70 and 29. No portion of the wellhead assembly is exposed to the high differential pressure unless that portion is rated for the high pressure.

The operator may perforate and perform multiple fracturing operations in stages. As is conventionally done, the operator lowers a releasable packer (not shown) on a tubular string through frac tree 81 and sets the packer within production casing 55. This procedure isolates lower zones that have already been fractured from upper zones.

Figure 6:
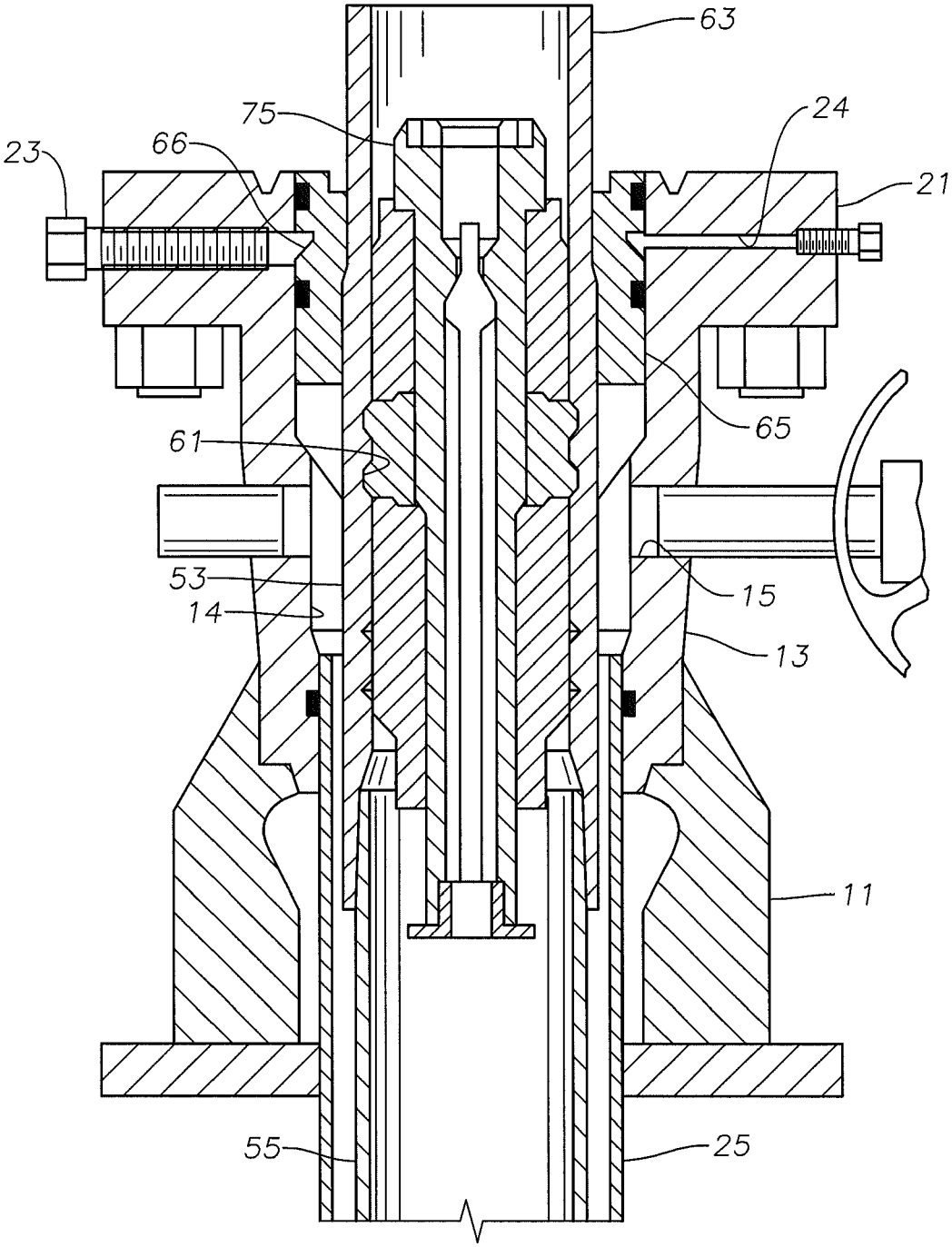
FIG. 6 is a sectional view of the wellhead assembly of FIG. 5 after the fracturing operation, showing the casing plug re-installed and the frac tree and drilling/frac adapter removed.

After the well fracturing operation has been completed, the operator may choose to bleed off the fracturing fluid until the well is dead. If so, the operator may then re-install casing plug 75 as illustrated in FIG. 6. Casing plug 75 is lowered through bore 85 and installed in the same place within casing hanger 53 as illustrated in FIG. 4. If after fracturing, the wellbore remains at a flowing pressure, the operator may install casing plug 75 through a conventional lubricator assembly attached to an upper end of frac tree 81. Once the wellbore is secured by casing plug 75, the operator may remove frac tree 81, then wear bushing 71. The operator removes upper packoff 67 and drilling/frac adapter 27. As shown in FIG. 6, casing hanger neck 63 will protrude above the upper end of lower housing 13 after drilling/frac adapter 27 is removed. Drilling/frac adapter 27, valve 31 and portions of upper packoff 67 may be re-used for another well.

Figure 7:
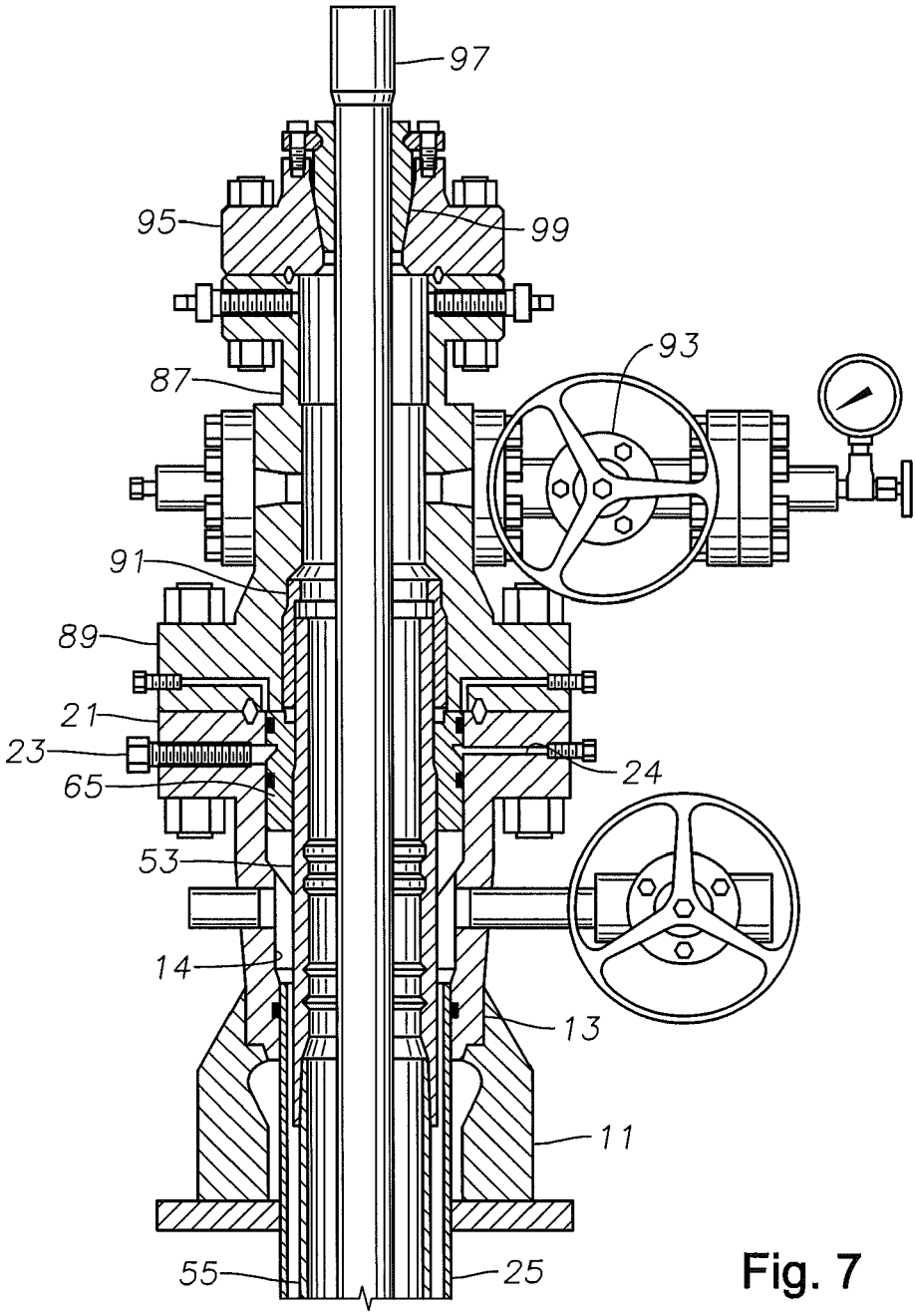
FIG. 7 is a sectional view of the wellhead assembly of FIG. 6, showing a tubing hanger and tubing head installed.

As shown in FIG. 7, the operator may then complete the well by installing an upper wellhead housing, also called a tubing head 87, on the upper end of lower housing 13. Tubing head 87 is conventional and may be a variety of types. Tubing head 87 comprises a tubular member and may be rated at the same pressure rating as lower housing 13 since the high pressure fracturing operation has already occurred. Tubing head 87 has a lower flange 89 that bolts to upper flange 21 of lower housing 13. A secondary seal bushing 91 may be installed to seal between the bore of tubing head 87 and the protruding portion of casing hanger neck 63. After tubing head 87 is installed, the operator may retrieve casing plug 75 through the bore of tubing head 87. Additional pressure control equipment may be attached to the upper end of tubing head 87 to allow retrieval of casing plug 75 under pressure, if needed. Tubing head 87 has conventional production valves 93 leading from its bore. As an example, a tubing attachment 95 supports a production tubing string 97 that is lowered through tubing head 87, casing hanger 53 and production casing 55. Many different arrangements for installing tubing are possible. Furthermore, the well may be configured such that production fluid flows through production casing 55, rather than through tubing.

The first embodiment, as illustrated in FIG. 5, does not employ a protective sleeve within casing hanger 53 during the fracturing operation. The reason is in order to keep a bore within the wellhead assembly that is large enough to run packers through that are to be set within casing 55. The procedure illustrated in FIG. 5 is preferably utilized with string of casing 53 have a constant inner diameter from lower housing 21 to the bottom of the well.

In many gas wells that undergo fracturing operations, the production casing string may be tapered; that is, it may include a lower section or liner that is smaller in diameter than the upper string. For example, production casing 55 may be 7" casing while a liner (not shown) attached to its lower end of casing 55 and forming a part thereof extends to the bottom of the well. The liner portion of the casing string may be 5½" casing. The upper end of the liner is hung off and sealed to a lower portion of the larger diameter casing. Often, the liner will be within a horizontal portion of the well.

If a liner is to be installed, the operator would drill the smaller diameter portion of the borehole after production casing 55 is cemented and upper and lower packoffs 65, 67 installed. A drilling wear bushing (not shown) may be located within the bore of casing hanger 53 to protect profile 61. The liner would subsequently be run and cemented in the wellbore. The steps described above and illustrated in FIG. 4 would take place.

Figure 8:
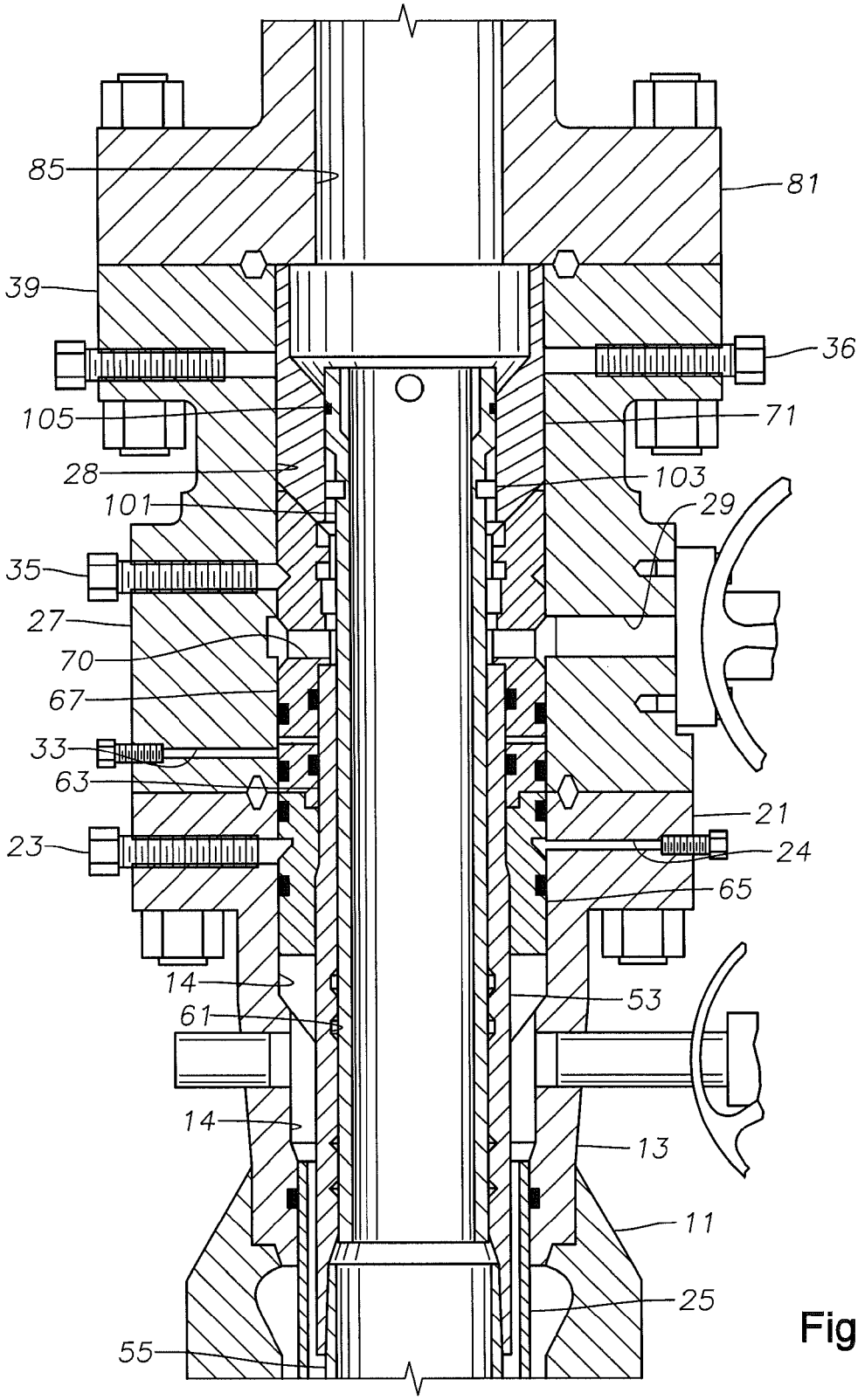
FIG. 8 is an enlarged sectional view of the wellhead assembly in the mode of FIG. 5, but with a frac sleeve installed.

Referring to FIG. 8, when the operator wishes to complete the well having a casing string with a liner, a frac sleeve 101 may be lowered through bore 85 of frac tree 81 and installed within the bores of frac wear bushing 71, upper packoff 67 and casing hanger 53. Frac sleeve 101 has pins 103 or some other anchoring device for landing within a profile in frac wear bushing 71. Frac sleeve 101 may have a seal 105 near its upper end that seals against the bore of wear bushing 71. Frac sleeve 101 extends downward through the full length of casing hanger 53, terminating approximately where production casing 55 attaches to casing hanger 53. Frac sleeve 101 does not seal to casing hanger 53 in this embodiment. Rather, it serves only to reduce erosion and wear along the inner diameter of casing hanger 53 during a fracturing process.

During a fracturing operation, the high pressure fluid within the bore of frac sleeve 101 may communicate up the small clearances between the lower end of frac sleeve 101 and the inner diameter of cashing hanger 53. Consequently, the pressure on the outer diameter of frac sleeve 101 should be approximately the same as the pressure on the inner diameter. Frac sleeve 101 necessarily has a smaller inner diameter than the inner diameter of production casing 55. Preferably, the inner diameter of frac sleeve 101 is equal to or larger than the inner diameter of the lower portion of the production casing string or liner. Consequently, during fracturing operations, a releasable packer may be lowered on drill pipe through frac sleeve 101 and set within the smaller diameter liner portion of the casing string for fracturing various zones or stages. Frac sleeve 101 can be retrieved through frac tree 81 to allow the re-installation of casing plug 75. Frac tree 81, frac wear bushing 71, drilling/frac adapter 27, and upper packoff 67 are then removed, as illustrated in FIG. 6. The well may be completed as described above.

The drilling/frac adapter assembly allows an operator to employ higher fracturing pressure than the rated pressure of the final wellhead assembly. An isolation device does not need to be inserted from the frac tree into the bore of the wellhead assembly in order to protect the wellhead assembly. The drilling/frac adapter, along with the high pressure valve and upper packoff, may be rented by an operator as it is utilized only during part of the drilling process and during the fracturing process. Alternately, an operator drilling many wells of a similar nature may re-use the drilling/frac adapter assembly.

While the disclosure has been shown in only two of its forms, it should be apparent to those skilled in the art that it is not so limited, but is susceptible to various changes without departing from the scope of the disclosure.

The invention claimed is:

1. A method of drilling and fracturing a well, comprising:
(a) installing a drilling/frac adapter on a lower wellhead housing, the drilling/frac adapter having a higher internal pressure rating than the lower wellhead housing;
(b) drilling through the drilling/frac adapter to a desired depth, then running and cementing a casing string in the well, the casing string having a casing hanger located partly in the lower wellhead housing and partly in the drilling/frac adapter;
(c) installing a lower packoff in an annulus between the casing hanger and the lower wellhead housing and an upper packoff in an annulus between the drilling/frac adapter and the casing hanger;
(d) installing a frac tree on the drilling/frac adapter and pumping frac fluid through the frac tree into the casing string at a higher pressure than the pressure rating of the lower housing but less than the pressure rating of the drilling/frac adapter, the upper packoff isolating the lower wellhead housing from the pressure of the frac fluid; and
(e) removing the upper packoff and the drilling/frac adapter from the lower housing and installing an upper wellhead housing on the lower wellhead housing.

2. The method according to claim 1, wherein:
the drilling/frac adapter has a valve port extending through a side wall; and wherein the method further comprises before step (b):
mounting a valve to the valve port, the valve having a pressure rating greater than the lower wellhead housing.

3. The method according to claim 2, wherein:
in step (c) the upper packoff seals to the drilling/frac adapter below the valve port; and
during step (d) the frac fluid being pumped into the frac tree is in fluid communication with the valve port and the valve.

4. The method according to claim 1, wherein step (d) further comprises installing a frac bushing on the upper packoff within the drilling frac/adapter.

5. The method according to claim 1, wherein step (c) comprises running the upper and lower packoffs simultaneously.

6. The method according to claim 1, wherein step (d) further comprises prior to pumping frac fluid, installing a protective sleeve within the upper packoff and casing hanger, and then pumping the frac fluid through the protective sleeve.

7. The method according to claim 6, wherein the protective sleeve admits frac fluid being pumped to an annular clearance between the protective sleeve and the casing hanger.

8. The method according to claim 1, further comprising:
installing a blowout preventer stack on the drilling/frac adapter before step (b);
after step (c) and before step (d), installing a retrievable plug in the casing hanger and removing the blowout preventer stack; and retrieving the plug through the frac tree before pumping frac fluid through the frac tree in step (d).

9. The method according to claim 1, further comprising:

after pumping frac fluid through the frac tree in step (d), installing a retrievable plug in the casing hanger before removing the frac tree in step (e).

10. The method according to claim 1, further comprising:

inserting a wear bushing into the drilling/frac adapter before drilling in step (b); and retrieving the wear bushing before running the casing string in step (b).

11. A method of drilling and fracturing a well, comprising:

(a) providing a drilling/frac adapter having a bore with an axis, a valve port extending laterally from the bore, and a valve mounted to the valve port;

(b) installing the drilling/frac adapter on a lower wellhead housing that has a lesser internal pressure rating than the drilling/frac adapter and the valve, then drilling through the drilling/frac adapter and the lower wellhead housing to a desired depth;

(c) running and cementing a casing string in the well, the casing string having a casing hanger landing in the lower wellhead housing and having an upper end within the bore of the drilling/frac adapter;

(d) installing a lower packoff in an annulus between the casing hanger and the lower wellhead housing and an upper packoff in an annulus between the drilling/frac adapter and the casing hanger below the valve port;

(e) installing a frac tree on the drilling/frac adapter and pumping frac fluid through the frac tree, the drilling/frac adapter, the casing hanger and into the casing string, the frac fluid exerting an internal pressure against the drilling/frac adapter, the casing hanger and the casing string, the upper packoff isolating the lower wellhead housing from the internal pressure of the frac fluid against against the lower wellhead housing; and (f) removing the upper packoff and the drilling/frac adapter from the lower housing and installing an upper wellhead housing on the lower wellhead housing.

12. The method according to claim 11, wherein step (e) further comprises installing a frac bushing on the upper packoff within the bore of the drilling frac/adapter.

13. The method according to claim 11, wherein step (d) comprises running the upper and lower packoffs simultaneously.

14. The method according to claim 11, wherein step (e) further comprises prior to pumping frac fluid, installing a protective sleeve within the upper packoff and the casing hanger, the protective sleeve having an inner diameter exposed to the pressure of the frac fluid being pumped.

15. The method according to claim 11, further comprising:

installing a blowout preventer stack on the drilling/frac adapter before drilling in step (b);

after step (d) and before step (e), installing a retrievable plug in the casing hanger and removing the blowout preventer stack; and retrieving the plug through the frac tree before pumping frac fluid through the frac tree in step (e).

16. The method according to claim 11, further comprising:

after pumping frac fluid through the frac tree in step (e), installing a retrievable plug in the casing hanger before removing the frac tree in step (f).

17. The method according to claim 11, further comprising:

inserting a wear bushing into the drilling/frac adapter before drilling in step (b); and retrieving the wear bushing before running the casing string in step (c).

* * * * *